United States Patent [19]

Shimizu et al.

[11] Patent Number: 4,892,425

[45] Date of Patent: Jan. 9, 1990

[54] THERMAL TRANSFER RECORDING APPARATUS AND INK SHEET CASSETTE THEREFOR

[75] Inventors: Hiroshi Shimizu; Naohiro Ozawa, both of Yokohama; Toshihiko Gotoh, Tokyo; Kentaro Hamma; Takeshi Nomura, both of Yokohama, all of Japan

[73] Assignee: Hitachi, Ltd., Tokyo, Japan

[21] Appl. No.: 139,826

[22] Filed: Dec. 30, 1987

[30] Foreign Application Priority Data

| | | | |
|---|---|---|---|
| Jan. 9, 1987 | [JP] | Japan | 62-1610 |
| Feb. 13, 1987 | [JP] | Japan | 62-29612 |
| Apr. 13, 1987 | [JP] | Japan | 62-88810 |

[51] Int. Cl.[4] ..... B41J 33/14; B41J 32/00; B41J 3/20

[52] U.S. Cl. ..... 400/120; 400/208; 400/243; 242/198

[58] Field of Search ..... 400/120, 208, 207, 208.1, 400/196, 242, 243, 245, 246, 227; 242/198

[56] References Cited

U.S. PATENT DOCUMENTS

| | | | |
|---|---|---|---|
| 4,400,103 | 8/1983 | Daughters | 400/208 |
| 4,480,936 | 11/1984 | Kasun et al. | 400/208 X |
| 4,650,357 | 3/1987 | Sidvers et al. | 400/208 |
| 4,687,358 | 8/1987 | Saitou | 400/120 X |
| 4,798,486 | 1/1989 | Kaneko | 400/208 |

FOREIGN PATENT DOCUMENTS

| | | | |
|---|---|---|---|
| 3241847 | 5/1984 | Fed. Rep. of Germany | 400/242 |
| 3504029 | 8/1985 | Fed. Rep. of Germany | 400/120 |
| 160274 | 7/1986 | Japan | 400/208 |

*Primary Examiner*—Clifford D. Crowder

*Attorney, Agent, or Firm*—Antonelli, Terry & Wands

[57] ABSTRACT

In a combination of a thermal transfer recording apparatus and an ink sheet cassette therefor, a take-up shaft of the ink sheet cassette has an outer diameter smaller than that of a supply shaft. A new ink sheet wound about the supply shaft to a location close to an inner wall surface of a supply shaft housing section of a cassette case is changed to a used ink sheet wrinkled due to heating by a thermal head. The used ink sheet having an increased thickness due to the wrinkles is taken up in the form of a roll about the take-up shaft. The roll of the used ink sheet entirely wound about the take-up shaft has such an outer diameter as to be out of contact with an inner wall surface of a take-up shaft housing section to thereby prevent contact of the take-up shaft with an inner wall surface of the cassette case due to an increase in the diameter of the roll of the used ink sheet wound about the take-up shaft.

14 Claims, 12 Drawing Sheets

THERMAL TRANSFER RECORDING APPARATUS AND INK SHEET CASSETTE THEREFOR

BACKGROUND OF THE INVENTION

The present invention relates to thermal recording apparatuses such as printers, facsimile and the like and, more particularly, to a combination of a thermal transfer recording apparatus and an ink sheet cassette therefor, which is excellent in operability of the ink sheet cassette and which is suitable to obtain high quality printing.

A recording apparatus is known in which printing of characters or images is are effected by the use of an ink sheet or sheets having applied thereto an ink. A manner of loading the ink sheet or sheets on the recording apparatus is put into practical use in various types of printers, typewriters and the like. In particular, a manner of conveniently loading an ink sheet or sheets relatively large in width on the recording apparatus is disclosed in, for example, Japanese Patent Application Laid-Open No. 56-67278, in which a supply shaft for supplying an ink sheet and a take-up shaft for taking up the ink sheet are mounted in the same cassette. A pinch roller is provided for superposing the ink sheet on a sheet to be printed when printing is effected. The pinch roller is connected to drive means for the supply and take-up shafts within the cassette, so that the ink sheet is fed out in response to the printing operation.

However, the above-described prior art leaves something to be desired. Specifically, the ink sheet cassette has the supply shaft having wound thereabout the ink sheet before use or new ink sheet, and the take-up shaft for taking up the ink sheet after use or used ink sheet. The supply shaft is accommodated in a supply shaft housing section of a cassette case of the ink sheet cassette. The supply shaft housing section has an inner diameter substantially equal to the maximum diameter of a roll of the new ink sheet wound about the supply shaft. The inner diameter of the supply shaft housing section has such a radial room as not to be brought into contact with the outer circumferential surface of the roll to prevent the inner wall surface of the supply shaft housing section from interfering with rotation of the supply shaft. On the other hand, the take-up shaft is accommodated in a take-up shaft housing section of the cassette case, and has an inner diameter equal to that of the supply shaft housing section in order to minimize the overall dimension of the cassette. When a thermal transfer ink sheet is used as the ink sheet in the cassette, heating by a thermal head results in partial elongation and contraction in the ink sheet to wrinkle the same, so that the wrinkled ink sheet is wound as it is about the take-up shaft. The outer diameter of the roll of the wrinkled ink sheet wound about the take-up shaft increases as compared with the roll diameter of the new ink sheet wound about the supply shaft. This would cause the outer circumferential surface of the roll of the wrinkled ink sheet to be brought into contact with the inner wall surface of the take-up shaft housing section of the cassette case, resulting in interruption of rotation of the take-up shaft. If this occurs, the used ink sheet would be unable to be taken up into the cassette, but would be caught within the printer.

SUMMARY OF THE INVENTION

It is an object of the invention to provide a combination of a thermal transfer recording apparatus and an ink sheet cassette therefor, which can prevent poor rotation of a take-up shaft due to an increase in outer diameter of a roll of an ink sheet wound about the take-up shaft resulting from wrinkles caused in the ink sheet at thermal transfer recording, thereby eliminating malfunction to enable high quality printing results to be obtained.

The invention is characterized in that the take-up shaft has an outer diameter smaller than that of the supply shaft, in order to dissolve the above-discussed problem that the roll diameter of the used ink sheet wound about the take-up shaft increases as compared with the roll diameter of the new ink sheet wound about the supply shaft so that the roll about the take-up shaft is brought into contact with the cassette case, resulting in poor rotation of the take-up shaft.

By making the outer diameter of the take-up shaft smaller than that of the supply shaft, an increase in the outer diameter of the roll of the used ink sheet wound about the take-up shaft does not cause the roll of the used ink sheet to be brought into contact with the inner wall surface of the take-up shaft housing section of the cassette case, thereby enabling the ink sheet to be taken up by the take-up shaft in a stable manner.

DETAILED DESCRIPTION

Various embodiments of an ink sheet cassette according to the invention will be described below with reference to the accompanying drawings.

Figure 1A:
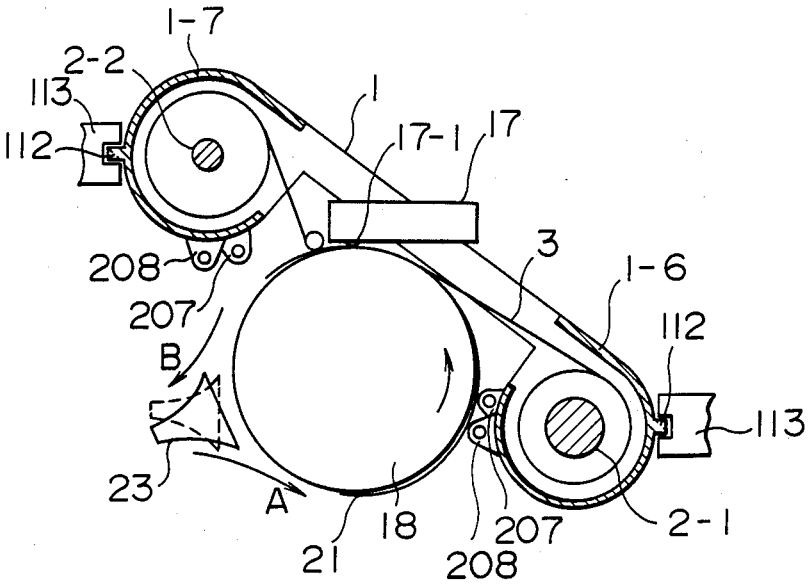
FIG. 1*a* is a front elevational view of an embodiment of a combination of a thermal transfer recording apparatus and an ink sheet cassette therefor according to the invention, with the ink sheet cassette shown in longitudinal cross-section for explanation of the operation.

Referring to FIG. 1*a*, there is illustrated a combination of a thermal transfer recording apparatus and an ink sheet cassette therefor loaded on the recording apparatus, according to an embodiment of the invention. The ink sheet cassette comprises a cassette case 1 which has a supply shaft housing section 1-6 and a take-up shaft housing section 1-7. A supply shaft 2-1 is rotatably mounted in the supply shaft housing section 1-6. The supply shaft 2-1 has wound thereabout an ink sheet 3 before use or new ink sheet in the form of a roll. A take-up shaft 2-2 is rotatably mounted in the take-up shaft housing section 1-7 for taking up the ink sheet after use or used ink sheet. The ink sheet 3 is fed out of the supply shaft 2-1 and is taken up by the take-up shaft 2-2 in response to motion of a mechanical arrangement subsequently to be described. The ink sheet has applied thereto a thermal transfer ink which is transferred by heat generated by a thermal head 17 to effect printing of characters or images. The ink applied to the ink sheet 3 may be monochromatic. Alternatively, inks of three colors including Ye, Mg and Cy may successively be applied respectively to longitudinally adjacent areas of the ink sheet 3, each of which areas corresponds to a single print image plane. Alternatively, inks of four colors including black in addition to the above-mentioned three colors may successively be applied to longitudinally adjacent areas of the ink sheet 3. Printing is effected in the following manner. That is, when the cassette case 1 is loaded on the recording apparatus, the ink sheet 3 is superposed on a platen or drum 18, and is urged against the drum 18 by the thermal head 17.

A cut sheet 21 to be printed is inserted in a direction indicated by the arrow A, and is wrapped about the drum 18 by rotation thereof. The sheet 21 to be printed is fed to a location confronted with the thermal head 17, with the sheet 21 nipped between the drum 18 and the ink sheet 3. On a surface of the thermal head 17 which is confronted with the drum 18, heating elements 17-1 of 512 dots are arranged in a line direction or along the axis of the drum 18, in other words, perpendicularly to the feed or advance direction of the ink sheet 3. Each dot varies in its heat generation amount in response to signals from the outside. Specifically, each of the heating elements 17-1 is formed by a resistor of 250 $\mu m \times 140\ \mu m$ in size. Time durations, for which electric current is passed through the respective heating elements 17-1, are controlled to adjust their respective heat generation amounts. Heat generated by the thermal head 17 heats the thermal transfer ink on the ink sheet 3, and the heated ink is transferred onto the sheet 21 to be printed. Time duration, for which electric current is passed through the thermal head 17, is controlled to adjust an amount of ink transferred from the ink sheet 3 onto the sheet 21, so that gradation controlled printing having light and shade is made possible on the sheet 21. After the above operation is effected for 512 dots, that is, one line, the drum 18 is rotated and is fed by one line. Subsequently, the above operation is again effected. This is repeated through 512 lines so that gradation printing having light and shade is effected on the sheet 21 at the respective $512 \times 512$ dots. When it is desired to record color images or pictures, printing of one image plane is first effected on the sheet 21 by the Ye ink. Subsequently, similar printing is effected on the same sheet 21 by the Mg ink. Finally, printing is effected by the use of the Cy ink.

After the sheet 21 is fed, the drum 18 having wrapped thereabout the sheet 21 is rotated by three revolutions, and printings for the respective three colors are effected respectively at the three revolutions of the drum 18. Subsequently, a sheet discharge block 23 is moved to an open position indicated by the broken lines in FIG. 1*a* to permit the sheet 21 to be fed in a direction indicated by the arrow B. Thus, printing of a single sheet 21 to be printed is completed. In case of monochromatic printing, the sheet 21 is discharged after single printing. In case of four color printing, the drum 18 is rotated through four revolutions, and printings for the respective four colors are effected on the same sheet 21 respectively at the four revolutions of the drum 18. Subsequently, the sheet 21 is discharged.

As shown in FIG. 1*a*, the take-up shaft 2-2 has an outer diameter smaller than that of the supply shaft 2-1. By doing so, even if the roll of the used ink sheet wound about the take-up shaft 2-2 increases in diameter due to wrinkles in the used ink sheet 3, the outer circumferential surface of the roll of the used ink sheet 3 is prevented from being brought into contact with the inner wall surface of the take-up shaft housing section 1-7 of the cassette case 1. In addition, the shaft housing sections 1-6 and 1-7 of the cassette case 1 are provided respectively with positioning subjected portions 112 and 112 extending along the axes of the respective supply and take-up shafts 2-1 and 2-2. On the other hand, positioning members 113 and 113 are provided on the mechanical section of the thermal transfer recording apparatus at locations corresponding respectively to the positioning subjected portions 112 and 112, to position the cassette case 1 within the thermal transfer recording apparatus.

Figure 1B:
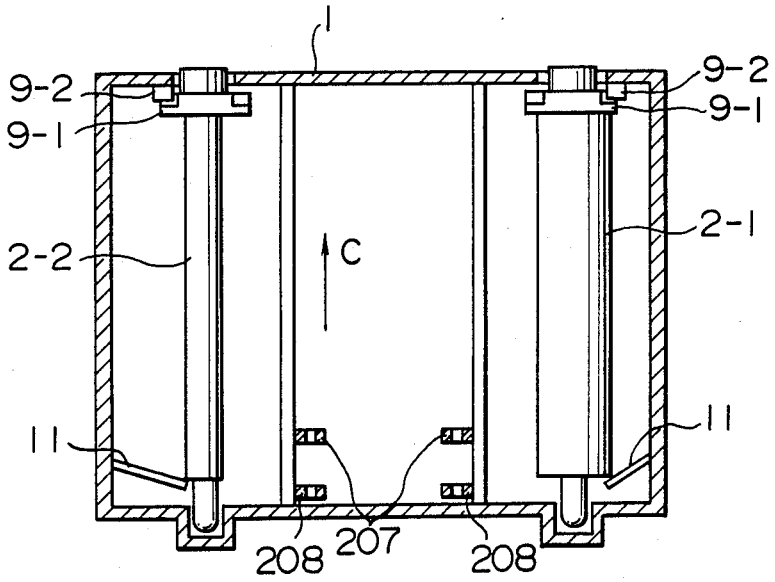
FIG. 1*b* is a lateral cross-sectional view of the ink sheet cassette illustrated in FIG. 1*a*.

The ink sheet cassette is shown in FIG. 1*b* in top plan view. The cassette case 1 is inserted into the thermal transfer recording apparatus in a direction indicated by the arrow C. When the cassette case 1 is inserted into the recording apparatus, the supply shaft 2-1 and the take-up shaft 2-2 are urged in a direction opposite to the arrowed direction C, and are moved while pushing respective shaft biasing members 11. The shaft biasing members 11 are molded integrally with the cassette case 1, and utilize resiliency due to the molding. As the supply and, take-up shafts 2-1 and 2-2 are moved in the direction opposite to the direction C, detent members 9-1 provided respectively on the supply and take-up shafts 2-1 and 2-2 are disengaged respectively from detent members 9-2 provided on the cassette case 1, permitting the shafts 2-1 and 2-2 to rotate freely. However, during a period for which the cassette is unloaded from the thermal transfer recording apparatus, the detent members 9-1 and 9-2 are brought into engagement with each other to lock the shafts 2-1 and 2-2 against rotation, thereby preventing slackening of the ink sheet 3 due to useless rotation of the shafts 2-1 and 2-2. Moreover, each of the shaft housing sections 1-6 and 1-7 of the cassette case 1 is provided with positioning members 207 and 208 having therein respective positioning bores, at two locations spaced a predetermined distance in the arrowed direction C, so that the ink sheet cassette is adapted to both of two types of thermal transfer recording apparatuses having their respective printing widths different from each other subsequently to be described.

Figure 2A:
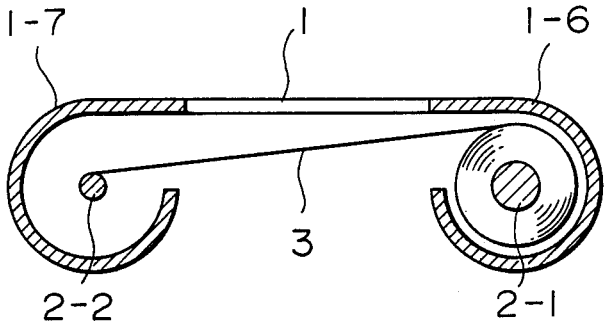
FIGS. 2*a* and 2*b* are cross-sectional views for explanation of the relationship between an ink sheet, a supply shaft and a take-up shaft of the ink sheet cassette illustrated in FIGS. 1*a* and 1*b*.
Figure 2B:
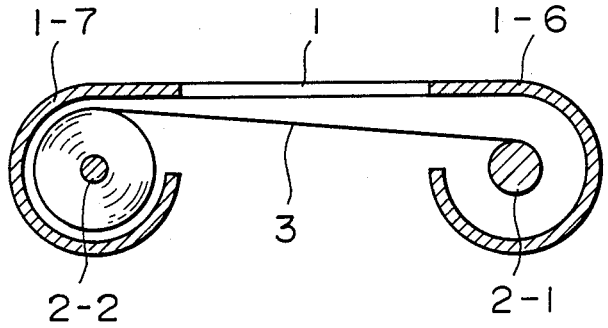

FIGS. 2*a* and 2*b* show only the ink sheet cassette illustrated in FIGS. 1*a* and 1*b*. As described previously, the diameter of the take-up shaft 2-2 is smaller than that of the supply shaft 2-1.

FIG. 2*a* illustrates the new ink sheet 3 which is entirely wound about the supply shaft 2-1. The roll of the new ink sheet 3 wound about the supply shaft 2-1 has an outer circumferential surface close to the inner wall surface of the supply shaft housing section 1-6. FIG. 2*b* illustrates the ink sheet 3 which has entirely been used and wound about the take-up shaft 2-2. The roll of the used ink sheet 3 wound about the take-up shaft 2-2 increases in diameter as compared with the diameter of the new ink sheet 3 wound about the supply shaft 2-1, as described previously. Since the diameter of the take-up shaft 2-2 is smaller than that of the supply shaft 2-1, however, it is possible to prevent the roll of the used ink sheet 3 wound about the take-up shaft 2-2 from being brought into contact with the inner wall surface of the take-up shaft housing section 1-7, even if the inner diameter of the take-up shaft housing section 1-7 is equal to that of the supply shaft housing section 1-6.

Figure 3A:
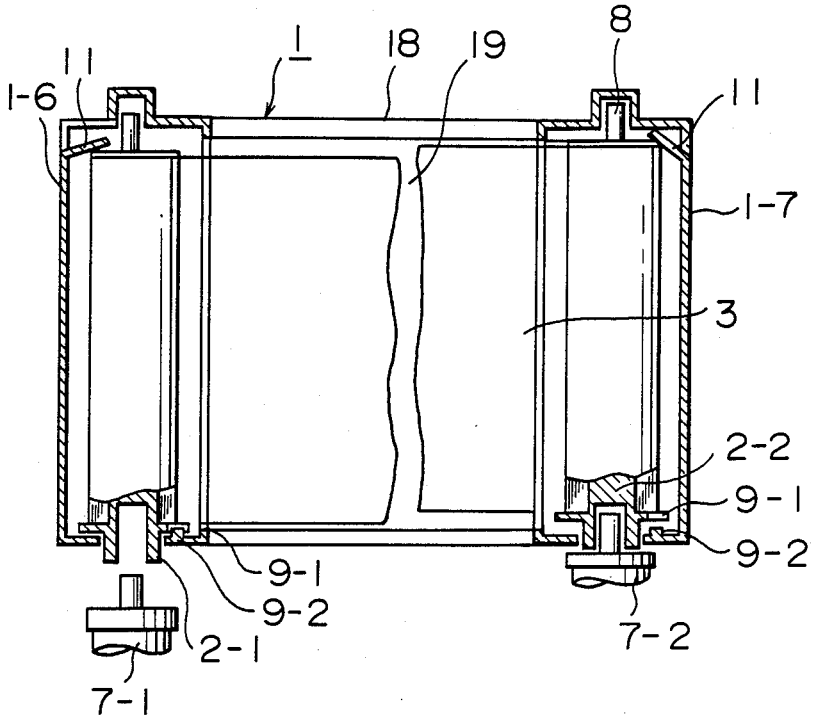
FIG. 3*a* is a cross-sectional view of the ink sheet cassette illustrated in FIG. 1*b*, for explanation of a rotation locking arrangement for the shafts.

FIG. 3*a* shows, upside down, the cassette illustrated in FIG. 1*b*. In the cassette according to the invention, the supply and take-up shafts 2-1 and 2-2 are movable between their respective first positions where the shafts are locked against rotation and respective second positions where the shafts are permitted to rotate freely. In FIG. 3*a*, the supply shaft 2-1 is illustrated as being moved to the first position, while the take-up shaft 2-2 is illustrated as being moved to the second position. This is merely for purposes of explanation, but in practice, when the supply shaft 2-1 is in one of the first and second positions, the take-up shaft 2-2 is in the same one of the first and second positions. During unloading of the cassette from the thermal transfer recording apparatus, as representatively illustrated by the supply shaft 2-1 in FIG. 3*a*, a drive shaft 7-1 for transmitting rotational torque from the thermal transfer recording apparatus to the supply shaft 2-1 is disengaged therefrom. During the unloading, the detent member 9-1 provided on the supply shaft 2-1 is brought into engagement with the detent member 9-2 provided on the cassette case 1 to lock the supply shaft 2-1 against rotation. The cassette case 1 is provided with the shaft biasing member 11 in the form a spring which is molded integrally with the cassette case 1 and which utilizes resiliency of the molded material per se. The shaft biasing member 11 biases the supply shaft 2-1 in such a direction as to bring the detent members 9-1 and 9-2 into engagement with each other. When the cassette case 1 is loaded on the thermal transfer recording apparatus, as representatively illustrated by the take-up shaft 2-2 in FIG. 3*a*, a drive shaft 7-2 is pushed into the take-up shaft 2-2. The drive shaft 7-2 urges the entire take-up shaft 2-2 toward its forward end 8 against the biasing force of the shaft biasing member 11. This brings the detent member 9-1 out of engagement with the detent member 9-2, to permit the take-up shaft 2-2 to rotate freely within the cassette case 1, so that the take-up shaft 2-2 follows rotation of the drive shaft 7-2 of the thermal transfer recording apparatus.

Figure 3B:
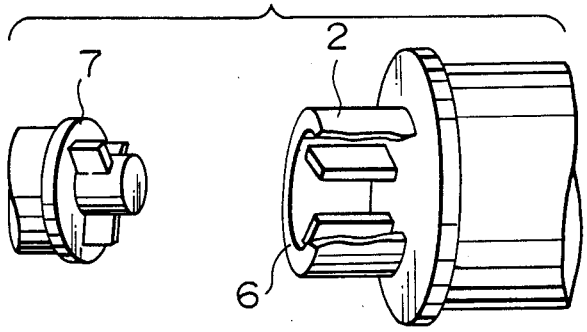
FIG. 3*b* is a partially broken-away, fragmental perspective view showing one of drive shafts and one of supply and take-up shafts illustrated in FIG. 3*a*.

FIG. 3*b* shows an example of a transmission mechanism for transmitting rotational torque from the thermal transfer recording apparatus to the cassette. The drive shaft 7 indicated as a representative of the drive shafts 7-1 and 7-2 in FIG. 3*a* is provided with pawls, while the ink shaft 2 indicated as a representative of the supply and take-up shafts 2-1 and 2-2 is provided with pawls to mate with the pawls of the drive shaft 7. When the drive shaft 7 is inserted into the ink shaft 2, their respective pawls mate with each other to transmit torque from the drive shaft 7 to the ink shaft 2. The drive shaft 7-2 drives the take-up shaft 2-2 to cause the same to take up the used ink sheet 3 in synchronism with the feed speed of the drum 18 shown in FIG. 1*a*. The drive shaft 7-1 drives the supply shaft 2-1 to cause the same to feed out the ink sheet 3 while imparting such tension to the ink sheet 3 as not to wrinkle the same.

Figure 4A:
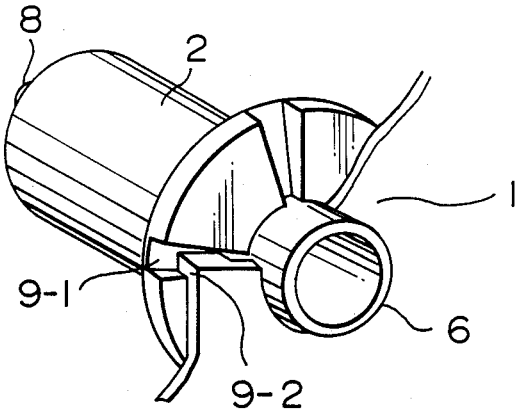
FIG. 4*a* is a partially broken-away, fragmental perspective view showing the configuration of the rotation locking arrangement illustrated in FIGS. 1*b* and 3*a*.
Figure 4B:
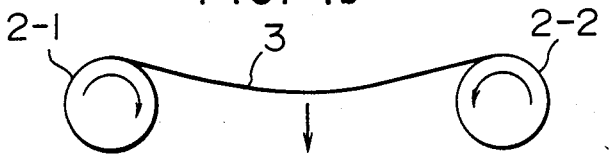
FIGS. 4*b* through 4*d* are views for explanation of a bad influence due to free rotation of the supply and take-up shafts.
Figure 4C:
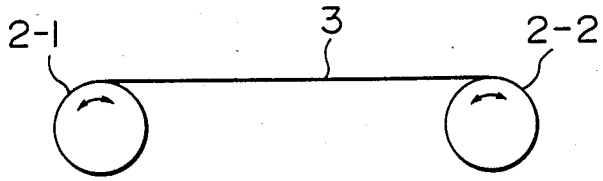

FIGS. 4*a* through 4*c* illustrate the rotation locking function for the ink shaft 2. FIG. 4*a* shows an example of the rotation locking arrangement for the ink shaft 2. The ink shaft 2 is mounted within the cassette case 1 for free rotation. The detent member 9-1 is mounted to an end face of the ink shaft 2, and desirably is formed by a part of the ink shaft 2. The detent member 9-2 is mounted to the cassette case 1, and desirably is formed by a part of the cassette case 1. The detent members 9-1 and 9-2 mate with each other to lock the ink shaft 2 against rotation. In FIG. 4*a*, the detent member 9-1 is illustrated as being a recess, while the detent member 9-2 is illustrated as being a projection, in which the projection is engageable with the recess. However, the detent member 9-1 may be a projection, while the detent member 9-2 may be a recess. Alternatively, other arrangements may be employed which has unlocking means. In the illustrated embodiment, a drive transmission portion 6 is urged toward the forward end 8 of the ink shaft 2 to disengage the detent members 9-1 and 9-2 from each other, thereby releasing the rotation locking.

Figure 4D:
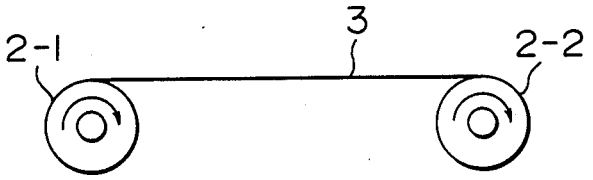

FIG. 4*b* illustrates motion of the supply and take-up shafts 2-1 and 2-2 and the ink sheet 3 when rotation locking is not applied to the shafts. It is supposed that vibration is applied to the cassette due to transportation and the like so that the supply shaft 2-1 rotates in the clockwise direction and the take-up shaft 2-2 rotates in the counterclockwise direction as viewed in FIG. 4*a*. Then, the ink sheet 3 slackens between the supply and take-up shafts 2-1 and 2-2 so that contamination and wrinkles occur on the slackening ink sheet portion due to contact thereof with other sections and the like, thereby resulting in deterioration of printed images or pictures at printing. FIG. 4c illustrates the shafts and the ink sheet when rotation locking is applied to the shafts. By the rotation locking, the supply and take-up shafts 2-1 and 2-2 are fixed against rotation and, accordingly, the ink sheet 3 is not fed out of the supply shaft 2-1 and is not taken up by the take-up shaft 2-2 so that the ink sheet 3 does not become loose. FIG. 4d illustrates the cassette which is mounted to the mechanical section of the thermal transfer recording apparatus. When mounted on the mechanical section, the detent member 9-1 on the ink shaft 2 is disengaged from the detent member 9-2 on the cassette case 1, to permit the ink shaft 2 to rotate freely. Once the cassette is mounted on the mechanical section, the supply and take-up shaft 2-1 and 2-2 completely follow motion of the respective drive shafts 7-1 and 7-2. Thus, the ink sheet 3 does not become loose, so long as the drive shafts 7-1 and 7-2 are not rotated intentionally. At printing, the drive shafts 7-1 and 7-2 feed the ink sheet 3 in one direction in synchronism with the printing speed.

Figure 5A:
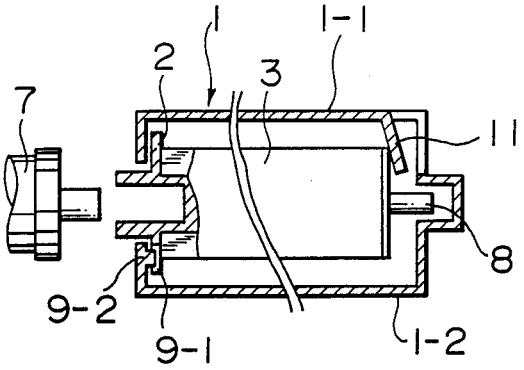
FIGS. 5*a* and 5*b* are cross-sectional views of another embodiment of the invention, which comprises a modification of the rotation locking arrangement for the supply and take-up shafts.
Figure 5B:
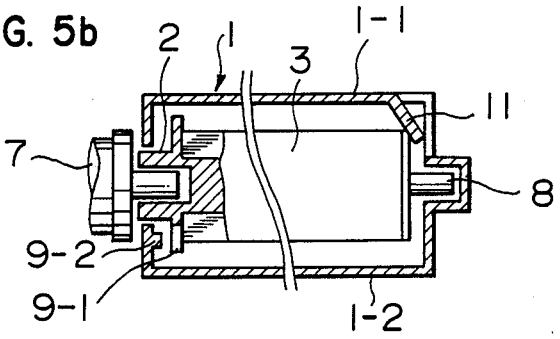
Figure 5C:
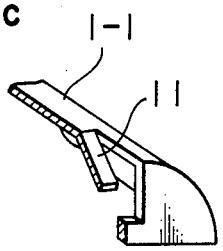
FIG. 5*c* is a partially broken-away, fragmental perspective view of a shaft biasing member of the rotation locking arrangement illustrated in FIGS. 5*a* and 5*b*.

FIGS. 5a through 5c illustrate another embodiment of the ink sheet cassette 1. FIG. 5a shows motion of a representative one of the shaft biasing members 11 provided on an upper case half 1-1 of the cassette case 1, for the respective supply and take-up shafts 2. The shaft biasing member 11 is formed in the form of a leaf spring by a part of the upper case half 1-1 and extends into the cassette case 1. The shaft biasing member 11 utilizes resiliency of the material of the cassette case 1 to have function of a spring. By the resiliency of this spring, the ink shaft 2 is biased toward the drive shaft 7 to bring the detent members 9-1 and 9-2 into engagement with each other, to thereby fix the ink shaft 2 against rotation. As shown in FIG. 5b, as the drive shaft 7 is pushed into the ink shaft 2, the ink shaft 2 is urged toward its forward end 8 against the biasing force due to the resiliency of the shaft biasing member 11. This moves the detent members 9-1 and 9-2 away from each other to permit the ink shaft 2 to rotate freely so that the ink shaft 2 follows motion of the drive shaft 7. FIG. 5c illustrates the shaft biasing member 11 formed on the upper case half 1-1 of the cassette case 1. A cut groove is formed in a part of the upper case half 1-1 of the cassette case 1 to form a piece which is bent inwardly to serve as the shaft biasing member 11. It is easy to form such piece serving as the shaft biasing member 11. Specifically, when the cassette case 1 is molded by plastic injection, plastic is injected into a mold cavity between a pair of upper and lower mold halves, and after solidification of the injected plastic, the mold halves are separated from each other. Thus, the above-mentioned piece serving as that shaft biasing member 11 can be formed. Accordingly, it is unnecessary to form the shaft biasing member 11 separately from the cassette case 1, so that high productivity is achieved. Further, in assembling the cassette case 1 having the configuration illustrated in FIG. 5a, the ink shaft 2 is mounted on the lower case half 1-2, and then the upper case half 1-2 is mounted on the lower case half 1-2 and is fitted or bonded thereto, so that assembling of the cassette is completed with the shaft biasing member 11 biasing the ink shaft 2 toward the drive shaft 7, as shown in FIG. 5a. Thus, the cassette is excellent for mass-production.

Figure 6A:
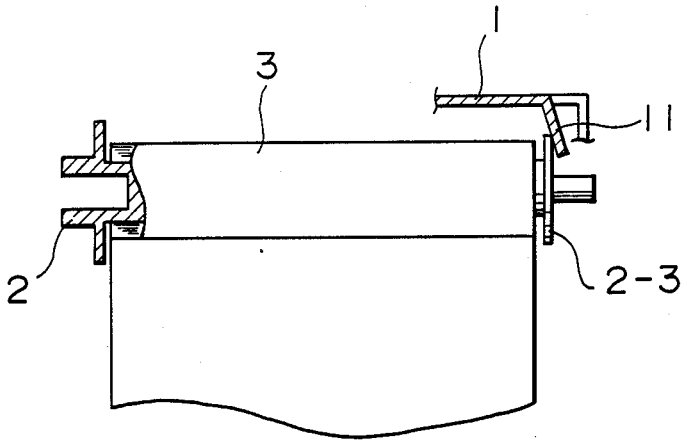
FIGS. 6*a* and 6*b* are cross-sectional views showing other embodiments of the invention, which comprise modifications of the rotation locking arrangement of the ink sheet cassette.
Figure 6B:
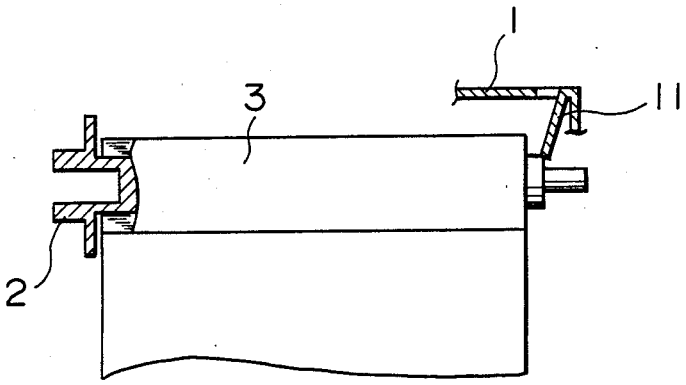

FIGS. 6a and 6b illustrate another embodiment of the ink sheet cassette according to the invention. FIG. 6a shows an example in which a force receiving member 2-3 is mounted on the ink shaft 2. When the shaft biasing member 11 utilizing a part of the material of the cassette case 1 is provided in a manner like that illustrated in FIG. 5c, the force receiving member 2-3 is provided to transmit the biasing force from the shaft biasing member 11 to the ink shaft, while preventing the shaft biasing member 11 from being into contact with the ink sheet 3 wound about the ink shaft 2. FIG. 6b shows an example in which the force receiving member 2-3 is not mounted on the ink shaft 2. The shaft biasing member 11 utilizing a part of the cassette case 1 is provided as illustrated in FIG. 6b, to urge an end face of the ink shaft 2 projecting from the end face of the roll of the ink sheet 3 wound about the ink shaft 2. Thus, the biasing force due to the shaft biasing member 11 is transmitted to the ink shaft 2 without contact of the shaft biasing member 11 with the ink sheet 3 wound about the ink shaft 2.

Figure 7:
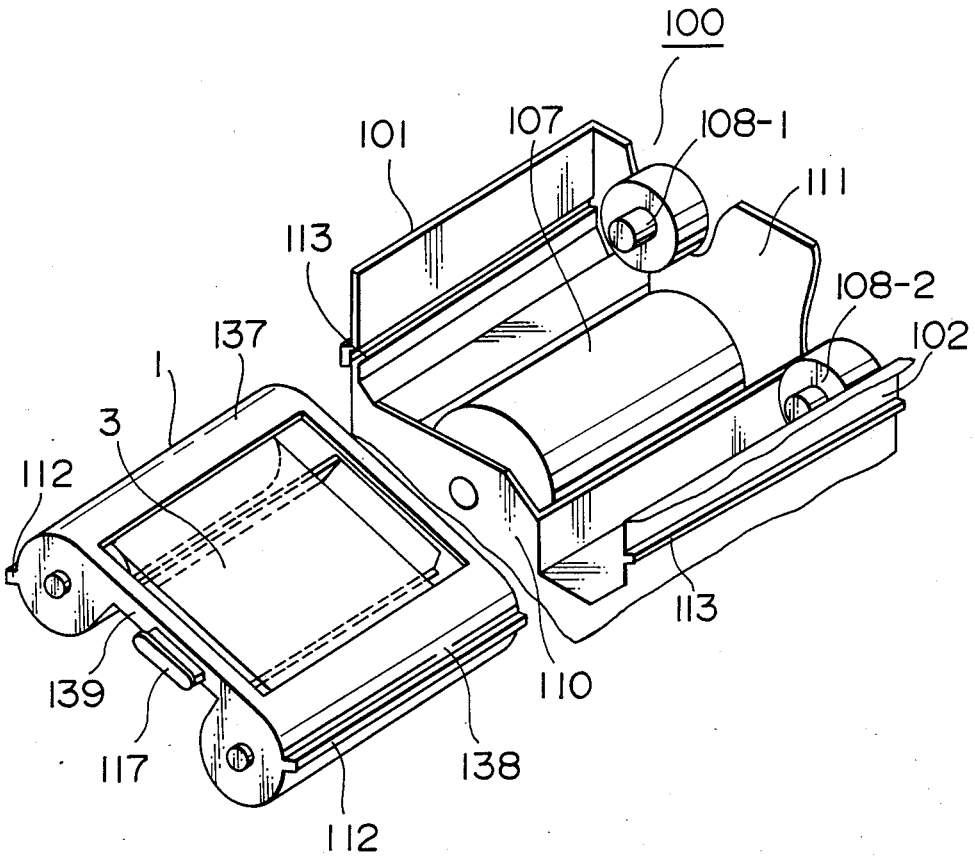
FIG. 7 is a perspective view showing a combination of a thermal transfer recording apparatus and an ink sheet cassette therefor according to another embodiment of the invention, which comprises positioning members for positioning the ink sheet cassette within the recording apparatus.

FIG. 7 shows, in perspective view, still another embodiment of the invention, which comprises a thermal transfer recording apparatus 100 and an ink sheet cassette therefor. The recording apparatus 100 comprises a chassis assembly including an inner chassis 111, an outer cassis 110, and left and right chassis 101 and 102 extending between the inner and outer chassis 111 and 110. Positioning members 113 and 113 each in the form of a groove extending in the direction of insertion of the cassette are provided respectively in the left and right chassis 101 and 102. Positioning subjected portions 112 and 112 in the form of projections corresponding respectively to the positioning members 113 and 113 are provided respectively on the outside of a take-up shaft housing section 138 and on the outside of a supply shaft housing section 137 of the cassette case 1.

As the cassette case 1 is inserted into the thermal transfer recording apparatus 100 with the positioning subjected portions 112 and 112 mating respectively with the positioning members 113 and 113, the supply and take-up shafts, not shown, but like those illustrated in FIGS. 1a and 1b, can be positioned such that the supply and take-up shafts are brought into engagement respectively with drive means 108-2 and 108-1.

According to the embodiment shown in FIG. 7, the supply and take-up shafts within the cassette case 1 can be positioned with high accuracy. Accordingly, the ink sheet 3 can be transported in parallel to the axis of a drum 107 without wrinkles, making it possible to keep high quality of printed images or pictures.

Figure 8:
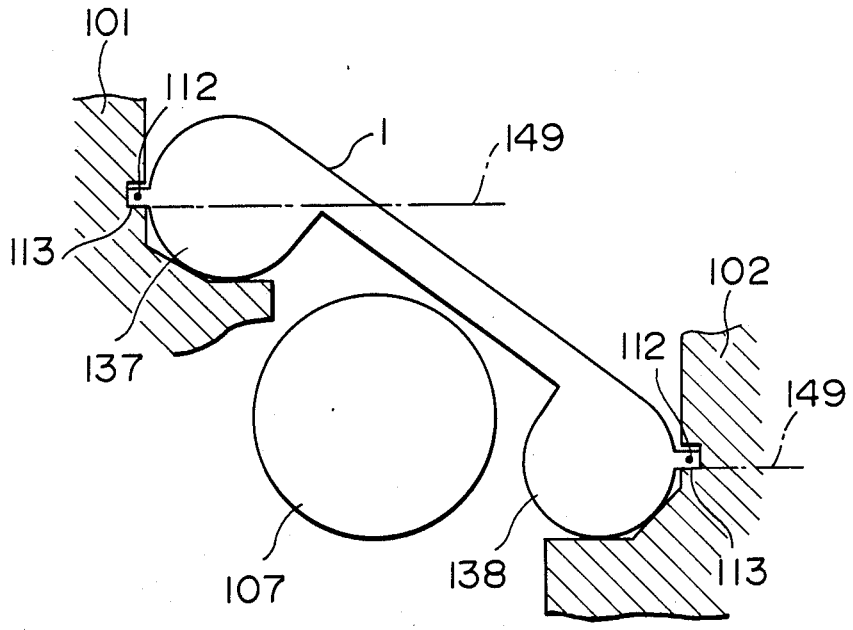
FIG. 8 is a cross-sectional view of the combination illustrated in FIG. 7, with the ink sheet cassette inserted into the recording apparatus.

FIG. 8 shows the ink sheet cassette which is illustrated in FIG. 7, but which is loaded on the thermal transfer recording apparatus 100. The embodiment shown in FIGS. 7 and 8 is characterized in that the positioning subjected portions 112 and 112 are provided respectively on the outside of the take-up shaft housing section 137 and on the outside of the supply shaft housing section 138, and the positioning members 113 and 113 are provided on the left and right chassis 101 and 102 such that the positioning subjected portions 112 and 112 are brought to the horizontal position 149 when the cassette is loaded on the thermal transfer recording apparatus 100. The cassette is inserted into the recording apparatus 100 in the manner described with reference to FIG. 7. In this connection, since the positioning subjected portions 112 and 112 are brought to the horizontal position 149, the weight of the cassette can be supported equally by the two positioning members 113 and 113.

Figure 9:
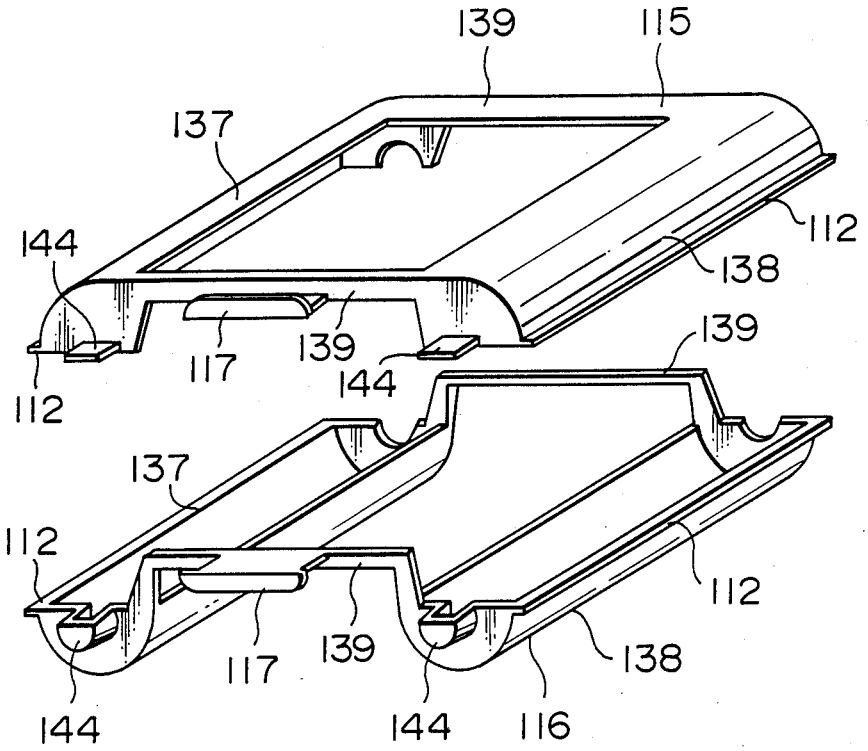
FIG. 9 is an exploded perspective view of a specific example of the ink sheet cassette illustrated in FIG. 7.

FIG. 9 shows, in an exploded perspective view, a specific example of the cassette illustrated in FIG. 7. The cassette comprises a cassette case 1 composed of an upper case half 115 and a lower case half 116. In the cassette case 1, positioning subjected portions 112, grip portions 117, take-up shaft housing sections 137, supply shaft housing portions 138, bonding portions 139, and projections 144 are provided respectively on the upper and lower case halves 115 and 116 in a separate manner. Although not shown, a take-up shaft and a supply shaft are prepared which are similar respectively to the take-up and supply shafts 2-2 and 2-1 illustrated in FIGS. 1*a* and 1*b*. The ink sheet 3 is wound about the supply shaft and extends between the supply and take-up shafts. The take-up and supply shafts are first mounted on the lower case half 116. The upper case half 115 is then superposed on the lower case half 116, and is bonded thereto to assemble the cassette.

It is possible for the embodiment illustrated in FIG. 9 to easily assemble the cassette. In particular, the right and left projections on the upper case half 115 are superposed respectively on the right and left projections on the lower case half 116 to form the positioning subjected portions 112 and 112. This makes it possible to utilize the bonding faces of the respective upper and lower case halves 115 and 116 as the positioning subjected portions 112 and 112. Thus, the illustrated embodiment is advantageous in that no special processing is necessary to form the positioning subjected portions 112 and 112. In addition, since each of the positioning subjected portions 112 and 112 is composed of two superposed pieces, the illustrated embodiment is advantageous in that the cassette case 1 can be enhanced in strength.

Figure 10:
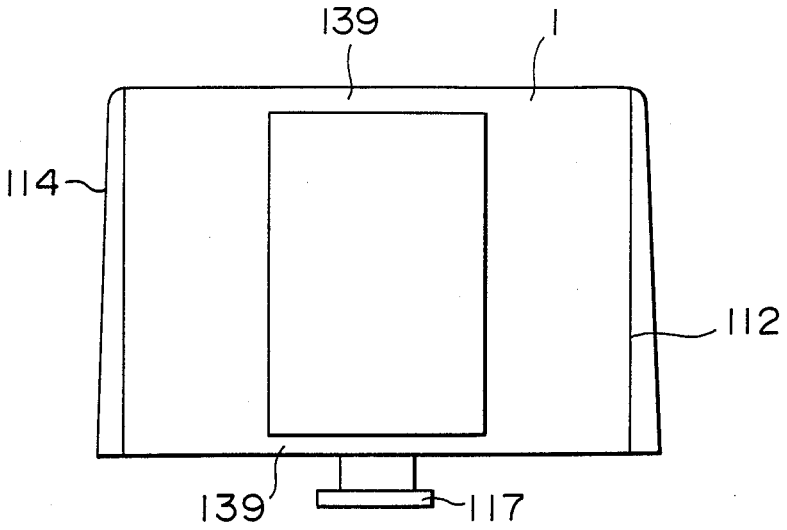
FIG. 10 is a top plan view of another embodiment of the ink sheet cassette according to the invention, which comprises a modification of positioning subjected portions.

FIG. 10 shows another embodiment of the invention, which is characterized in that each of the positioning subjected portions 112 and 112 has an outside face which is tapered at 114 such that the width of the positioning subjected portion 112 increases toward the grip portion 117.

When the cassette shown in FIG. 10 is loaded on the thermal transfer recording apparatus, the tapered outside faces 114 and 114 facilitate insertion of the cassette into the recording apparatus. In addition, the cassette is positioned at sections of the positioning subjected portions 112 and 112, which are located adjacent the grip portion 117 and which have relatively large width. This makes it possible to secure performance of the thermal transfer recording apparatus in combination with the ink sheet cassette.

Figure 11:
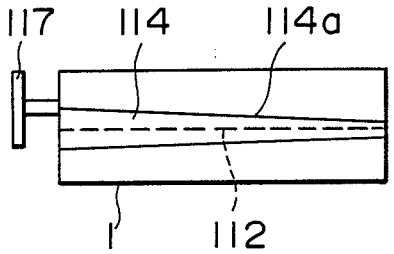
FIG. 11 is a side elevational view of still another embodiment of the ink sheet cassette according to the invention, which comprises a modification of the positioning subjected portions.

FIG. 11 shows another embodiment of the ink sheet cassette according to the invention, which is characterized in that each of the positioning subjected portions 112 has an outside face which is tapered at 114*a* such that the positioning subjected portion 112 has its thickness increasing toward the grip portion 117. It is possible for the illustrated embodiment to improve operability of the ink sheet cassette.

Figure 12:
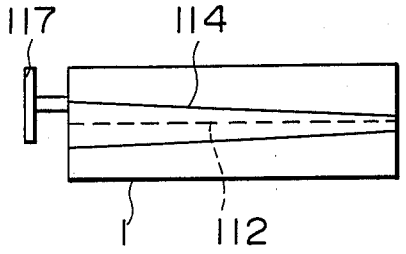
FIG. 12 is a view similar to FIG. 11, but showing still another modification of the positioning subjected portions.

FIG. 12 shows still another embodiment of the ink sheet cassette according to the invention, in which each of the positioning subjected portions 112 has a tapered upper face 114 and a flat lower face that is not tapered toward the upper face. The embodiment illustrated in FIG. 12 has advantages similar to those of the embodiment shown in FIG. 8 and, in addition thereto, is advantageous in that when the cassette is loaded on the thermal transfer recording apparatus, not shown, the cassette is prevented from slipping due to its own weight so that the cassette is stabilized in posture.

Figure 13:
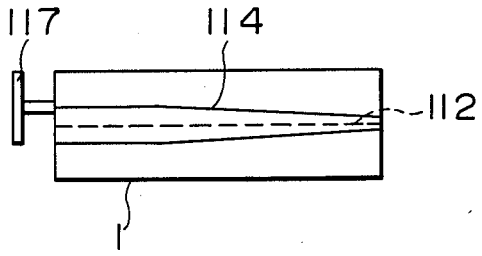
FIG. 13 is a view similar to FIG. 11, but showing another modification of the positioning subjected portions.

FIG. 13 shows another embodiment of the ink sheet cassette according to the invention, which is characterized in that each of the positioning subjected portions 112 has an upper face partially tapered at 114 and a lower face partially tapered at 114. The remaining face sections of the respective upper and lower faces adjacent the grip portion 117 are flat and extend in parallel relation to each other. The embodiment illustrated in FIG. 13 has advantages similar to those of the embodiment shown in FIG. 8. In addition, if loading and unloading of the cassette on and from the thermal transfer recording apparatus, not shown, are repeated, the cassette can engage the recording apparatus at relatively large areas, i.e., at the parallel sections of the positioning subjected portions 112 other than the tapered sections 114 thereof. Thus, it is possible to reduce wear on the positioning subjected portions 122 so that the cassette can withstand use for a long period of time. The arrangement of FIG. 13 is applicable to the embodiments shown respectively in FIGS. 10 and 12. If the arrangement of FIG. 13 is applied to the embodiments of FIGS. 10 and 12, it is possible for the embodiments of FIGS. 10 and 12 to achieve advantages similar to those of the embodiment shown in FIG. 13. Thus, the arrangement of FIG. 13 is extremely effective.

Figure 14A:
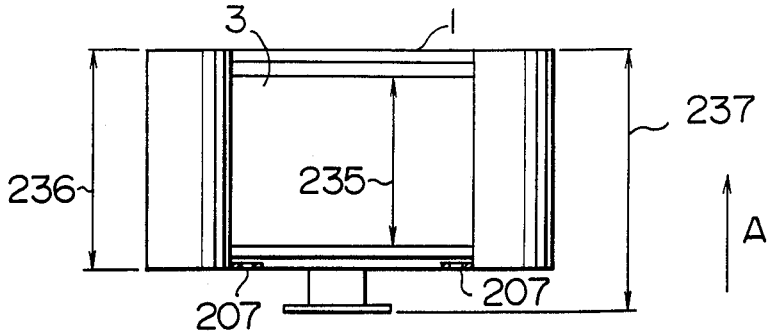
FIGS. 14*a* through 14*c* are top plan views of still another embodiment of the ink sheet cassette according to the invention, showing a manner of positioning the cassette.
Figure 14B:
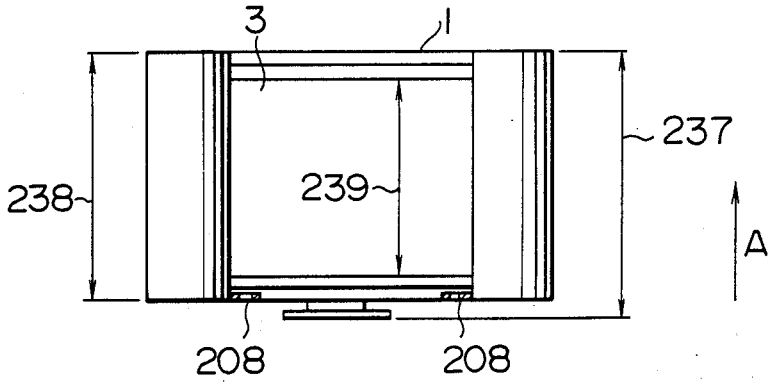
Figure 14C:
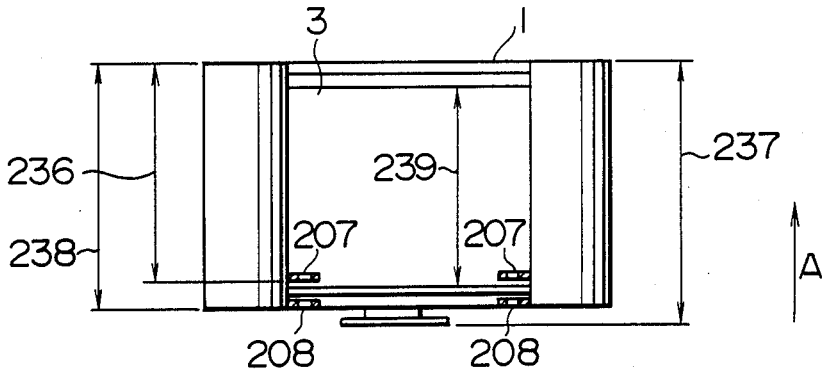

FIGS. 14*a* through 14*c* show still another embodiment of the ink sheet cassette according to the invention. There may be a case where the width of the ink sheet used differs from type to type of thermal transfer recording apparatuses. In other words, there may be a case where a thermal transfer recording apparatus of type A effects printing by the use of an ink sheet having relatively narrow width, while a thermal transfer recording apparatus of type B effects printing by the use of an ink sheet having relatively large width. In this case, the recording apparatus of type A is different in width of a mechanical section from the recording apparatus of type B. Accordingly, it is necessary for such different types of recording apparatuses to use their respective ink sheet cassettes different in configuration from each other. From the combination of the ink sheet cassette and the thermal transfer recording apparatus according to the invention, however, it is possible to employ the same cassette for a plurality of types of thermal transfer recording apparatuses different in ink sheet width from each other. FIG. 14*a* shows an example of an ink sheet cassette which is employed in a thermal transfer recording apparatus which effects printing by the use of an ink sheet relatively narrow in width, while FIG. 14*b* shows an example of an ink sheet cassette which is employed in a thermal transfer recording apparatus which effects printing by the use of an ink sheet relatively large in width. The cassette shown in FIG. 14*a* uses the ink sheet having its width 235. A pair of positioning members 207 and 207 for supporting the cassette are provided respectively at locations spaced a positioning member distance 236 from the leading end of the cassette case 1 with reference to the direction A of insertion of the cassette. The positioning members 207 and 207 are provided therein with respective bores like those provided in the positioning members 207 and 207 illustrated in FIG. 1*a*. These bores are used in combination with positioning pins on the thermal transfer recording apparatus subsequently to be described, to position the cassette within the recording apparatus.

The positioning member distance 236 is set to a value slightly greater than the ink sheet width 235.

The cassette shown in FIG. 14 employs the ink sheet having its width 239. The cassette illustrated in FIG. 14*b* is the same as that illustrated in FIG. 14*a* in the configuration, the arrangement of positioning members 208 and 208, the combination of the positioning members with pins on the thermal transfer recording apparatus, and the setting of the positioning member distance 238. The ink sheet width 239 in the cassette shown in FIG. 14*b* is greater than the ink sheet width 235 in the cassette shown in FIG. 14*a*. The ink sheet width 239 in the cassette shown in FIG. 14*b* covers the narrow ink sheet width 235 in the thermal transfer recording apparatus which employs the cassette illustrated in FIG. 14*a*. Accordingly, it is possible to utilize the ink sheet shown in FIG. 14*b* in the thermal transfer recording apparatus which employs the cassette shown in FIG. 14*a*. However, the positioning member distance 238 in the cassette of FIG. 14*b* is also greater than the distance 236 in the cassette of FIG. 14*a*. Accordingly, it is impossible to use the cassette of FIG. 14*b* in the thermal transfer recording apparatus employing the cassette shown in FIG. 14*a*, because the positioning members in the cassette of FIG. 14*b* are different in their position from those in the cassette of FIG. 14*a*. FIG. 14*c* shows an example in which the cassette case 1 is provided thereon with the positioning members 207 and 207 and the positioning members 208 and 208. In the cassette shown in FIG. 14*c*, the positioning members 207 and 207 are provided respectively at locations spaced the positioning member distance 236 from the leading end of the cassette case 1, while the positioning members 208 and 208 are provided respectively at locations spaced the positioning member distance 238 from the leading end of the cassette case 1. The ink sheet has the same width 239 as that of the ink sheet in the cassette illustrated in FIG. 14*b*, so that the ink sheet is adapted to printing effected by the use of the ink sheet narrow in width shown in FIG. 14*a* and to printing effected by the use of the ink sheet large in width shown in FIG. 14*b*. When the cassette illustrated in FIG. 14*c* is loaded on the thermal transfer recording apparatus which effects printing by the use of the ink sheet narrow in width, the positioning pins, not shown, on the thermal transfer recording apparatus are inserted respectively into the bores in the respective positioning members 207 and 207, to position the cassette case 1 within the thermal transfer recording apparatus. On the other hand, when the cassette illustrated in FIG. 14*c* is loaded on the thermal transfer recording apparatus which effects printing by the use of the ink sheet larger in width, the positioning pins, not shown, on the thermal transfer recording apparatus are inserted respectively into the bores in the respective positioning members 208 and 208, to position the cassette case 1 within the thermal transfer recording apparatus. In this case, the cassettes shown respectively in FIGS. 14*a*, 14*b* and 14*c* are made equal to each other in the overall width 237, thereby making it possible to load the cassettes on the thermal transfer recording apparatuses.

Figure 15:
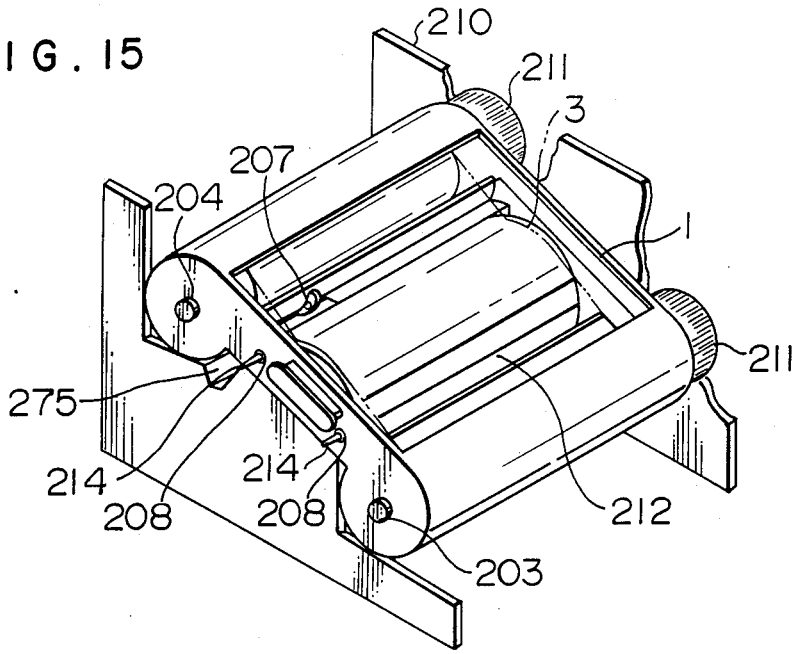
FIG. 15 is a perspective view showing the cassette illustrated in FIG. 14*c*, which is loaded on a thermal transfer recording apparatus.

FIG. 15 shows, in perspective view, the ink sheet cassette according to the invention, which is loaded on the thermal transfer recording apparatus which effects printing by the use of the ink sheet large in width. Because the entire ink sheet width is utilized, a drum 212 is correspondingly large in width or long in axial length. Positioning point 214 on the thermal transfer recording apparatus are inserted respectively into the bores in the respective positioning members 208 and 208, to position the cassette within the recording apparatus. In this case, the positioning members 207 and 207 are not utilized, but enter the recording apparatus. By this reason, a mechanical section 210 of the recording apparatus is provided with a relief position 275, to prevent a corresponding one of the positioning members 207 from being into contact with the mechanical section 210 when the cassette is inserted into the thermal transfer recording apparatus.

Figure 16:
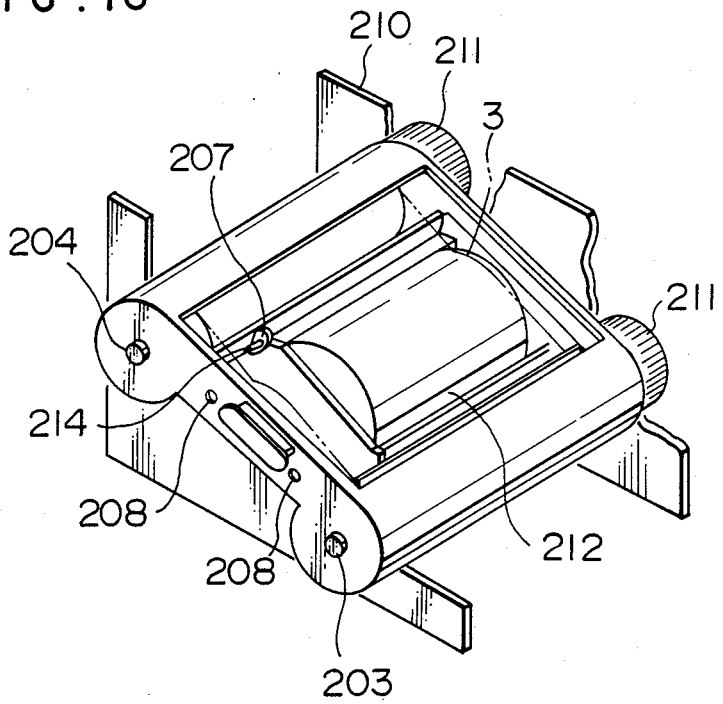
FIG. 16 is a view similar to FIG. 15, but showing the cassette illustrated in FIG. 14*c*, which is loaded on a different thermal transfer recording apparatus.

FIG. 16 shows, in perspective view, the cassette according to the invention, which is loaded on the thermal transfer recording apparatus which effects printing by the use of the ink sheet narrow in width. Because a part of the ink sheet width is utilized, the drum 212 is correspondingly narrow in width or short in axial length. The positioning pins 214 (only one shown) are inserted respectively into the bores in the respective positioning members 207 (only one shown) to position the cassette within the thermal transfer recording apparatus. The combination of the thermal transfer recording apparatus and the ink sheet cassette therefor according to the invention makes it possible to use the same cassette for a plurality of types of thermal transfer recording apparatuses which employ their respective ink sheets different in width.

As described above, it is possible for the invention to prevent contact of the roll of the ink sheet with the inner wall surface of the take-up shaft housing section due to an increase in diameter of the roll of the ink sheet wound about the take-up shaft resulting from wrinkles caused in the ink sheet by heating of the ink sheet at printing. Poor rotation of the take-up shaft due to the above-mentioned contact can accordingly be eliminated. This makes it possible to transport or feed the ink sheet in a stable manner without getting caught in the thermal transfer recording apparatus. Further, according to the invention, the rotation locking arrangement for the supply and take-up shafts comprises the detent members mounted to the cassette case and to the supply and take-up shafts, and the shaft biasing members formed by parts of the cassette case. By the provision of such portion locking arrangement, it is made possible to prevent slackening of the ink sheet during unloading of the cassette from the thermal transfer recording apparatus, without any increase in number of component parts. Thus, deterioration in performance and a possibility of malfunction due to wrinkles in the ink sheet can be eliminated by the rotation locking arrangement which is low in cost. Moreover, by the provision of the positioning members on the lateral sides of the cassette to fix the position thereof within the thermal transfer recording apparatus, the ink sheet can stably be fed and taken up without induction of wrinkles in the ink sheet, making it possible to prevent deterioration in quality of the printed images or pictures and simultaneously to reduce a possibility of malfunction. Furthermore, by the provision of the positioning members having therein their respective positioning bores at a plurality of locations, the same ink sheet cassette can be adapted to a plurality of types of thermal transfer recording apparatuses which effect printing by the use of their respective ink sheets different in width from each other. Thus, interchangeability of the cassette can be enhanced.

What is claimed is:

1. A combination of a thermal transfer recording apparatus and an ink sheet cassette therefor, said ink sheet cassette comprising a cassette case having, in a united form, a supply shaft housing section, a take-up shaft housing section and means for connecting-said supply shaft housing section and said take-up shaft housing section to each other, a supply shaft rotatably mounted within said supply shaft housing section, a take-up shaft rotatably mounted within said take-up shaft housing section, and an ink sheet having applied thereto thermal transfer ink, the ink sheet before use or new ink sheet being wound in the form of a continuous roll about said supply shaft, the ink sheet extending between said supply shaft and said take-up shaft, the ink sheet after use or used ink sheet being taken up about said take-up shaft, said supply shaft housing section having an inner diameter substantially equal to an outer diameter of the roll of the new ink sheet wound about said supply shaft, said take-up shaft housing section having an inner diameter substantially equal to said inner diameter of said supply shaft housing section; and said thermal transfer recording apparatus comprising a chassis assembly defining a cassette loading section on which said ink sheet cassette is to be loaded, said chassis assembly having an inner chassis, drive means mounted on said inner chassis for driving one end of the respective supply and take-up shafts, and a print section having a drum and a thermal head, said thermal head cooperating with said drum to pinch therebetween a sheet to be printed and the new ink sheet in superposed relation to effect printing on the sheet to be printed, wherein the new ink sheet, wound about said supply shaft to a location close to an inner wall surface of said supply shaft housing section of said cassette case, is changed to the used ink sheet, the used ink sheet being wrinkled due to heating by said thermal head, the used ink sheet having an increased thickness due to the wrinkles, and wherein said take-up shaft has an outer diameter sufficiently smaller than that of said supply shaft such that, when the used ink sheet is taken up in the form of a roll about said take-up shaft, the roll of the used ink sheet entirely wound about said take-up shaft has such an outer diameter as to be out of contact with an inner wall surface of said take-up shaft housing section, to thereby prevent contact of said take-up shaft with an inner wall surface of said cassette case due to an increase in the diameter of the roll of the used ink sheet wound about said take-up shaft, whereby the distance between the outer diameter of the take-up shaft and inner diameter of the take-up shaft housing section is increased, as compared to the distance between the outer diameter of the supply shaft and inner diameter of the supply shaft housing section, without increasing the inner diameter of the take-up shaft housing section.

2. A combination of a thermal transfer recording apparatus and an ink sheet cassette therefor as defined in claim 1, wherein said ink sheet cassette includes positioning subjected portions formed respectively on outer sides of said supply shaft housing section and said take-up shaft housing section in parallel with said supply shaft and said take-up shaft, and said thermal transfer recording apparatus includes positioning members corresponding respectively to said positioning subjected portions, said positioning members and said positioning subjected portions cooperating with each other to position said ink sheet cassette within said thermal transfer recording apparatus.

3. A combination of a thermal transfer recording apparatus and an ink sheet cassette therefor as defined in claim 1, wherein said supply shaft and said take-up shaft are movable in an axial direction, within the cassette, and wherein said ink sheet cassette includes rotation locking means for effecting engagement of said supply shaft and spring-like shaft biasing means for keeping said rotation locking means in operation, said supply shaft and said take-up shaft being pressed in the axial direction to move said shaft biasing means away from the rotation locking means so that the engagement by said rotation locking means is released when said ink sheet cassette is loaded on said thermal transfer recording apparatus.

4. A combination of a thermal transfer recording apparatus and an ink sheet cassette therefor as defined in claim 3, wherein the shaft biasing means is a leaf spring formed by a part of the housing of the respective supply shaft housing section and the take-up shaft housing section.

5. A combination of a thermal transfer recording apparatus and an ink sheet cassette therefor as defined in claim 1, wherein the supply shaft housing section and take-up shaft housing section are spaced from each other, with an ink sheet transfer path therebetween constituting said means for connecting said supply shaft housing section and said take-up shaft housing section to each other.

6. An ink sheet cassette for a thermal transfer recording apparatus, said ink sheet cassette comprising a supply shaft, a take-up shaft, and an ink sheet having applied thereto thermal transfer ink, the ink sheet before use or new ink sheet being wound in the form of a continuous roll about said supply shaft, the ink sheet extending between said supply shaft and said take-up shaft, the ink sheet after use or used ink sheet being taken up about said take-up shaft, said thermal transfer recording apparatus comprising a chassis assembly defining a cassette loading section on which said ink sheet cassette is to be loaded, said chassis assembly having an inner chassis, drive means mounted on said inner chassis for driving one end of the respective supply and take-up shafts, and a print section having a drum and a thermal head, said thermal head cooperating with said drum to pinch therebetween a sheet to be printed and the new ink sheet in superposed relation to effect printing on the sheet to be printed;

said ink sheet cassette comprising:

a cassette case having, in a united form, a supply shaft housing section, a take-up shaft housing section and means for connecting said supply shaft housing section and said take-up shaft housing section to each other;

said supply shaft rotatably mounted within said supply shaft housing section;

said take-up shaft rotatably mounted within said take-up shaft housing section;

said supply shaft housing section having an inner diameter substantially equal to an outer diameter of the roll of the new ink sheet wound about said supply shaft;

said take-up shaft housing section having an inner diameter substantially equal to said inner diameter of said supply shaft housing section; and wherein the new ink sheet, wound about said supply shaft to a location close to an inner wall surface of said supply shaft housing section of said cassette case, is changed to the used ink sheet, the used ink sheet being wrinkled due to heating by said thermal head, the used ink sheet, having an increased thickness due to the wrinkles, is taken up in the form of a roll about said take-up shaft, and wherein said take-up shaft has an outer diameter sufficiently smaller than that of said supply shaft such that the roll of the used ink sheet entirely wound about said take-up shaft has such an outer diameter as to be out of contact with an inner wall surface of said take-up shaft housing section, to thereby prevent contact of said take-up shaft with an inner wall surface of said cassette case due to an increase in the diameter of the roll of the used ink sheet wound about said take-up shaft, whereby the distance between the outer diameter of the take-up shaft and inner diameter of the take-up shaft housing section is increased, as compared to the distance between the outer diameter of the supply shaft and inner diameter of the supply shaft housing section, without increasing the inner diameter of the take-up shaft housing section.

7. An ink sheet cassette as defined in claim 6, wherein said ink sheet cassette includes positioning subjected portions formed respectively on outer sides of said supply shaft housing section and said take-up shaft housing section in parallel with said supply shaft and said take-up shaft, and said thermal transfer recording apparatus includes positioning members corresponding respectively to said positioning subjected portions, said positioning members and said positioning subjected portions cooperating with each other to position said ink sheet cassette within said thermal transfer recording apparatus.

8. An ink sheet cassette as defined in claim 7, wherein the positioning subjected portions are at least partially tapered such that the positioning subjected portions are relatively thin at the end thereof first contacting the positioning members, and relatively thick at the end thereof which last contacts the positioning members, in loading the ink sheet cassette into the thermal transfer recording apparatus.

9. An ink sheet cassette as defined in claim 6, wherein said supply shaft and said take-up shaft are movable in an axial direction, within the cassette, and wherein the cassette further includes rotation locking means for effecting engagement of said supply shaft and said take-up shaft with said cassette case, and spring-like shaft biasing means for keeping said rotation locking means in operation, whereby said supply shaft and said take-up shaft are pressed in the axial direction by the spring-like shaft biasing means so as to be locked against rotation by said rotation locking means so as to prevent the ink sheet from being wrinkled during a period for which said ink sheet cassette is unloaded from the thermal transfer recording apparatus, and are pressed in the axial direction to move away from the rotation locking means so that the engagement by the rotation locking means is released when the cassette is loaded on the thermal transfer recording apparatus.

10. An ink sheet cassette as defined in claim 9, further comprising force receiving members respectively mounted on the supply shaft and the take-up shaft, to be contacted by the shaft biasing means so as to lock the supply shaft and the take-up shaft against rotation when the ink sheet cassette is unloaded from the thermal transfer recording apparatus.

11. An ink sheet cassette as defined in claim 9, wherein the shaft biasing means is a leaf spring formed by a part of the housing of the respective supply shaft housing section and the take-up shaft housing section.

12. An ink sheet cassette as defined in claim 6, wherein the supply shaft housing section and take-up shaft housing section are spaced from each other, with an ink sheet transfer path therebetween constituting said means for connecting said supply shaft housing section and said take-up shaft housing section to each other.

13. A combination of a thermal transfer recording apparatus and an ink sheet cassette therefor, said ink sheet cassette comprising a cassette case having, in a united form, a supply shaft housing section, a take-up shaft housing section and means for connecting said supply shaft housing section and said take-up shaft housing section to each other, a supply shaft rotatably mounted within said supply shaft housing section, a take-up shaft rotatably mounted within said take-up shaft housing section, sand an ink sheet having applied thereto thermal transfer ink, the ink sheet before use or new ink sheet being wound in the form of a continuous roll about said supply shaft, the ink sheet extending between said supply shaft and said take-up shaft, the ink sheet after use or used ink sheet being taken up about said take-up shaft, said supply shaft housing section having an inner diameter substantially equal to an outer diameter of the roll of the new ink sheet wound about said supply shaft, said take-up shaft housing section having an inner diameter substantially equal to said inner diameter of said supply shaft housing section; and said thermal transfer recording apparatus comprising a chassis assembly defining a cassette loading section on which said ink sheet cassette is to be loaded, said chassis assembly having an inner chassis, drive means mounted on said inner chassis for driving one end of the respective supply and take-up shafts, and a print section having a drum and a thermal head, said thermal head cooperating with said drum to pinch therebetween a sheet to be printed and the new ink sheet in superposed relation to effect printing on the sheet to be printed, wherein the new ink sheet, wound about said supply shaft to a location close to an inner wall surface of said supply shaft housing section of said cassette case, is changed to the used ink sheet, the used ink sheet being wrinkled due to heating by said thermal head, the used ink sheet having an increased thickness due to the wrinkles, and wherein said take-up shaft has an outer diameter sufficiently smaller than that of said supply shaft such that, when the used ink sheet is taken up in the form of a roll about said take-up shaft, the roll of the used ink sheet entirely wound about said take-up shaft has such an outer diameter as to be out of contact with an inner wall surface of said take-up shaft housing section, to thereby prevent contact of said take-up shaft with an inner wall surface of said cassette case due to an increase in the diameter of the roll of the used ink sheet wound about said take-up shaft; and wherein said ink sheet cassette includes at least one positioning member having a plurality of positioning bores provided respectively at a plurality of locations along each of said supply shaft and said take-up shaft, said thermal transfer recording apparatus having at least one positioning pin provided for insertion into a corresponding one of said positioning bores of said ink sheet cassette, so that the same ink sheet cassette may be used for a plurality of types of thermal transfer recording apparatuses different from each other in width of an ink sheet used.

14. An ink sheet cassette for a thermal transfer recording apparatus, said ink sheet cassette comprising a supply shaft, a take-up shaft, and an ink shaft having applied thereto thermal transfer ink, the ink sheet before use or new ink sheet being wound in the form of a continuous roll about said supply shaft, the ink sheet extending between said supply shaft and said take-up shaft, the ink sheet after use or used ink sheet being taken up about said take-up shaft, said thermal transfer recording apparatus comprising a chassis assembly defining a cassette loading section on which said ink sheet cassette is to be loaded, said chassis assembly having an inner chassis, drive means mounted on said inner chassis for driving one end of the respective supply and take-up shafts, and a print section having a drum and a thermal head, said thermal head cooperating with said drum to pinch therebetween a sheet to be printed and the new ink sheet in superposed relation to effect printing on the sheet to be printed;

said ink sheet cassette comprising:

a cassette case having, in a united form, a supply shaft housing section, a take-up shaft housing section and means for connecting said supply shaft housing section and said take-up shaft housing section to each other;

said supply shaft rotatably mounted within said supply shaft housing section;

said take-up shaft rotatably mounted within-said take-up shaft housing section;

said supply shaft housing section having an inner diameter substantially equal to an outer diameter of the roll of the new ink sheet wound about said supply shaft; and said take-up shaft housing section having an inner diameter substantially equal to said inner diameter of said supply shaft housing section;

wherein the new ink sheet, wound about said supply shaft to a location close to an inner wall surface of said supply shaft housing section of said cassette case, is changed to the used ink sheet, the used ink sheet being wrinkled due to heating by said thermal head, the used ink sheet, having an increased thickness due to the wrinkles, is taken up in the form of a roll about said take-up shaft, and wherein said take-up shaft has an outer diameter sufficiently smaller than that of said supply shaft such that the roll of the used ink sheet entirely wound about said take-up shaft has such an outer diameter as to be out of contact with an inner wall surface of said take-up shaft with an inner wall surface of said cassette case due to an increase in the diameter of the roll of the used ink sheet wound about said take-up shaft; and wherein said ink sheet cassette includes at least one positioning member having a plurality of positioning bores provided respectively at a plurality of locations along each of said supply shaft and said take-up shaft, said thermal transfer recording apparatus having at least one positioning pin provided for insertion into a corresponding one of said positioning bores of said ink sheet cassette, so that the same ink sheet cassette may be used for a plurality of types of thermal transfer recording apparatuses different from each other in width of an ink sheet used.

* * * * *